US012532965B2

(12) United States Patent
Li et al.

(10) Patent No.: US 12,532,965 B2
(45) Date of Patent: Jan. 27, 2026

(54) LINKAGE DEVICE FOR IMPLEMENTING NO BACKREST CLEARANCE, SUPPORTING FRAME, SEAT UNIT, AND SEAT

(71) Applicant: Remacro Technology Co., Ltd., Jiangsu (CN)

(72) Inventors: Xiaohong Li, Jiangsu (CN); Yuankun Li, Jiangsu (CN); Chen Chen, Jiangsu (CN); Xiaochun Lei, Jiangsu (CN); Zhanzheng Lv, Jiangsu (CN)

(73) Assignee: Remacro Technology Co., Ltd., Suzhou (CN)

( * ) Notice: Subject to any disclaimer, the term of this patent is extended or adjusted under 35 U.S.C. 154(b) by 251 days.

(21) Appl. No.: 18/523,879

(22) Filed: Nov. 30, 2023

(65) Prior Publication Data

US 2024/0090668 A1 Mar. 21, 2024

Related U.S. Application Data

(63) Continuation of application No. PCT/CN2022/081000, filed on Mar. 15, 2022.

(30) Foreign Application Priority Data

May 31, 2021 (CN) ..... 202110601343.3
May 31, 2021 (CN) ..... 202110601360.7
(Continued)

(51) Int. Cl.
*A47C 1/02* (2006.01)
*A47C 1/034* (2006.01)
(Continued)

(52) U.S. Cl.
CPC ..... *A47C 1/0345* (2013.01)

(58) Field of Classification Search
CPC ..... A47C 1/0355; A47C 1/0352; A47C 1/035; A47C 1/03211; A47C 1/03294;
(Continued)

(56) References Cited

U.S. PATENT DOCUMENTS 3,869,170 A * 3/1975 James ..... A47C 1/0342 297/269.1
4,492,407 A * 1/1985 Broadhead ..... A47C 1/035 297/78
(Continued)

FOREIGN PATENT DOCUMENTS

CN 107660910 A 2/2018
CN 108836001 A 11/2018
(Continued)

OTHER PUBLICATIONS

International Search Report of PCT Patent Application No. PCT/CN2022/081000 issued on May 25, 2022.

*Primary Examiner* — Shin H Kim

(57) ABSTRACT

A linkage device for implementing no backrest clearance, a supporting frame, a seat unit, and a seat, including a bottom base, a linkage mechanism, a support side plate, and a backrest mechanism; the support side plate is provided with a side plate linkage point and a backrest point; the support side plate is rotatably connected to the linkage mechanism at the side plate linkage point; the support side plate is rotatably connected to the backrest mechanism at the backrest point; the backrest mechanism includes a backrest mounting member and a backrest linkage member; and when the backrest mechanism is retracted to an ultimate position, an included angle α between a connecting line between two ends of the backrest mounting member and a connecting line between the backrest point and the side plate linkage point is an acute angle.

17 Claims, 8 Drawing Sheets

(30) Foreign Application Priority Data

| | | |
|---|---|---|
| May 31, 2021 | (CN) | 202110603973.4 |
| May 31, 2021 | (CN) | 202110603981.9 |
| May 31, 2021 | (CN) | 202121198813.8 |
| May 31, 2021 | (CN) | 202121198815.7 |
| May 31, 2021 | (CN) | 202121200209.4 |

(51) Int. Cl.
*A47C 1/035* (2006.01)
*A47C 1/038* (2006.01)
*A47C 7/00* (2006.01)

(58) Field of Classification Search
CPC ..... A47C 1/0342; A47C 20/08; A47C 1/036; A47C 1/032; A47C 20/041; A47C 1/0345; A47C 1/0242; A47C 7/54
See application file for complete search history.

(56) References Cited

U.S. PATENT DOCUMENTS

| | | | | | |
|---|---|---|---|---|---|
| 4,740,031 | A * | 4/1988 | Rogers, Jr. | A47C 1/0345 | 297/85 L |
| 4,863,215 | A * | 9/1989 | Crum | A47C 1/0355 | 297/85 L |
| 4,943,114 | A * | 7/1990 | Piretti | A47C 7/44 | 403/80 |
| 5,192,113 | A * | 3/1993 | Wiecek | A47C 1/0345 | 297/68 |
| 7,147,278 | B2 * | 12/2006 | Johnson | A47C 1/0352 | 297/85 R |
| 7,497,512 | B2 * | 3/2009 | White | A47C 1/0355 | 297/89 |
| 7,641,277 | B2 * | 1/2010 | Lawson | A47C 1/0352 | 297/85 L |
| 7,766,421 | B2 * | 8/2010 | Lawson | A47C 1/0355 | 297/85 M |
| 8,308,228 | B2 * | 11/2012 | Lawson | A47C 1/029 | 297/331 |
| 8,573,687 | B2 * | 11/2013 | Lawson | A47C 1/0342 | 297/90 |
| 9,050,231 | B2 * | 6/2015 | Masters | A61G 5/14 | |
| 9,375,089 | B2 * | 6/2016 | Lawson | A47C 1/0342 | |
| 9,386,857 | B2 * | 7/2016 | Lawson | A47C 1/0355 | |
| 9,468,295 | B2 * | 10/2016 | Lawson | A47C 1/0355 | |
| 9,700,140 | B2 * | 7/2017 | Lawson | A47C 1/0345 | |
| 10,420,422 | B2 * | 9/2019 | Lawson | A47C 1/0355 | |
| 10,575,644 | B2 * | 3/2020 | Bryant | A47C 1/0355 | |
| 10,897,995 | B2 * | 1/2021 | Crum | A47C 1/0355 | |
| 11,638,483 | B2 * | 5/2023 | Sun | A47C 1/03211 | 297/75 |
| 2008/0111402 | A1 * | 5/2008 | Crum | A47C 1/0355 | 297/85 R |
| 2008/0150329 | A1 * | 6/2008 | Lawson | A47C 1/0355 | 297/84 |
| 2011/0175404 | A1 * | 7/2011 | Lawson | A47C 3/027 | 297/83 |
| 2011/0175426 | A1 * | 7/2011 | Lawson | A47C 1/0355 | 297/85 M |
| 2012/0049606 | A1 * | 3/2012 | Lawson | A47C 1/0355 | 74/521 |
| 2014/0049079 | A1 * | 2/2014 | Lawson | A47C 1/0342 | 297/84 |
| 2014/0049084 | A1 * | 2/2014 | Lawson | A47C 1/032 | 297/340 |
| 2014/0333099 | A1 * | 11/2014 | Lu | A47C 1/0355 | 297/83 |
| 2015/0282619 | A1 * | 10/2015 | Lawson | A47C 1/0355 | 297/83 |
| 2015/0289655 | A1 * | 10/2015 | Lawson | A47C 1/0342 | 297/75 |
| 2016/0029800 | A1 * | 2/2016 | Bryant | A47C 1/0242 | 297/284.3 |
| 2016/0045031 | A1 * | 2/2016 | Lawson | A47C 7/506 | 297/284.3 |
| 2016/0100687 | A1 * | 4/2016 | Murphy | A47C 1/0347 | 297/271.3 |
| 2016/0273632 | A1 * | 9/2016 | Lawson | F16H 25/20 | |
| 2016/0302573 | A1 * | 10/2016 | Garland | A47C 1/0352 | |
| 2017/0127834 | A1 * | 5/2017 | Lawson | A47C 7/24 | |
| 2017/0135486 | A9 * | 5/2017 | Lawson | A47C 7/00 | |
| 2018/0027968 | A1 | 2/2018 | Lawson et al. | | |
| 2020/0367652 | A1 * | 11/2020 | Crawford | A47C 1/03211 | |
| 2024/0164527 | A1 * | 5/2024 | Li | A47C 7/5068 | |
| 2024/0172876 | A1 * | 5/2024 | Li | A47C 17/163 | |
| 2024/0374031 | A1 * | 11/2024 | Tan | A47C 1/0355 | |
| 2025/0024946 | A1 * | 1/2025 | Cao | A47C 1/03211 | |
| 2025/0204692 | A1 * | 6/2025 | Robertson | A47C 19/022 | |

FOREIGN PATENT DOCUMENTS

| | | | |
|---|---|---|---|
| CN | 109363412 | A | 2/2019 |
| CN | 112155356 | A | 1/2021 |
| CN | 212521294 | U | 2/2021 |
| CN | 213155030 | U | 5/2021 |
| KR | 20050076623 | A | 7/2005 |

* cited by examiner

LINKAGE DEVICE FOR IMPLEMENTING NO BACKREST CLEARANCE, SUPPORTING FRAME, SEAT UNIT, AND SEAT

CROSS REFERENCE TO RELATED APPLICATIONS

The present application is a Continuation Application of PCT Application No. PCT/CN2022/081000 filed on Mar. 15, 2022, which claims the benefit of Chinese Patent Application Nos. 202121198815.7, 202121200209.4, 202121198813.8, 202110601360.7, 202110603973.4, 202110601343.3, 202110603981.9 filed on May 31, 2021. All the above are hereby incorporated by reference in their entirety.

FIELD OF THE INVENTION

The present application relates to the technical field of seat supporting frames, in particular to a linkage device for implementing no backrest clearance, a supporting frame, a seat unit, and a seat.

BACKGROUND OF THE INVENTION

Multifunctional sofas or seats have become widely used furniture in smart home living. Multifunctional sofas are usually able to be adjusted to a retracted position for normal sitting, an extended position with only legs extended, and a reclined position with both legs and the back fully extended.

In the mechanical extendable device for adjusting positions in the prior art, if a seat backrest is positioned against a wall and a reclined position is achieved with a backrest mechanism rotated backward, the seat backrest may contact the wall adjacent thereto, which may interfere with the rotation of the backrest mechanism. Therefore, it is necessary to reserve a space for the backrest extension, which occupies a large amount of space. The existing functional seats that may be positioned against the wall with no clearance may restrict the extension of legs and backrest, or restrict the angle adjustment of the backrest mechanism and the seat backrest, resulting in unfavorable seat comfort, and the existing seat backrests with backrest adjustment functions are monotonous in style.

SUMMARY OF THE INVENTION

An objective of the present application is to solve the problem of a large space occupied by the seat backrest in the prior art, which is unable to be provided against a wall with no clearance or to restrict the adjustment of the backrest angle, resulting in unfavorable comfort.

In order to achieve the objective mentioned above, proposed in the present application is a linkage device for implementing no backrest clearance, including a bottom base, a linkage mechanism, a support side plate and a backrest mechanism; the linkage mechanism is rotatably connected between the bottom base and the support side plate; the backrest mechanism is rotatably connected to the support side plate and the linkage mechanism respectively;

the support side plate is provided with a side plate linkage point and a backrest point; the support side plate is rotatably connected to the linkage mechanism at the side plate linkage point; the support side plate is rotatably connected to the backrest mechanism at the backrest point;

the backrest mechanism includes a backrest mounting member and a backrest linkage member; two ends of the backrest mounting member are rotatably connected between the backrest point and the backrest linkage member respectively; and when the backrest mechanism is retracted to an ultimate position, an included angle $\alpha$ between a connecting line between two ends of the backrest mounting member and a connecting line between the backrest point and the side plate linkage point is an acute angle.

Further, the support side plate includes a backrest connecting part and an L-shaped side plate body, in which the side plate body and the backrest connecting part are formed integrally or fixedly connected.

Further, the backrest connecting part is provided at an end of the support side plate connected to the backrest mechanism, in which the backrest point is provided on the backrest connecting part.

Further, when the backrest mechanism is retracted to an ultimate position, an included angle $\alpha$ between a connecting line between two ends of the backrest mounting member and a connecting line between the backrest point and the side plate linkage point is less than 70°.

Further, when the backrest mechanism is extended to an ultimate position, an included angle $\beta$ between a connecting line between two ends of the backrest mounting member and a connecting line between the backrest point and the side plate linkage point is less than 45°.

Further, the backrest mounting member is provided with a protruding frame mounting part, in which the frame mounting part is used for mounting a seat backrest of a seat; when the linkage device is extended to an ultimate position, an included angle $\gamma$ between the frame mounting part and a horizontal plane is less than or equal to 35°.

Provided in the present application is also a seat supporting frame, including a bottom base, a linkage mechanism, a support side plate and a backrest mechanism; the linkage mechanism is rotatably connected between the bottom base and the support side plate; the backrest mechanism is rotatably connected to the support side plate and the linkage mechanism respectively;

the linkage mechanism includes a first supporting member, a swinging member, a middle connecting member, a linkage member, and a second supporting member; the first supporting member and the second supporting member are rotatably connected to two ends of the bottom base respectively; the swinging member is connected to the first supporting member; two ends of the middle connecting member are connected to the swinging member and the linkage member respectively;

the linkage member is provided with a linkage point and a support connecting point; the linkage member is connected to the middle connecting member at the linkage point; the linkage member is connected to the second supporting member at the support connecting point; L1 is a connecting line between the linkage point and the support connecting point, while L2 is a connecting line between the support connecting point and a connecting point between the second supporting member and the bottom base; and when the linkage mechanism is extended to an ultimate position, an included angle $\delta$ between L1 and L2 ranges from 8° to 15°.

Further, when the linkage mechanism is extended forward to an ultimate position, an included angle $\varepsilon$ between the second supporting member and a horizontal plane is less than 42°.

Further, A1 is a distance between the linkage point and the support connecting point, while A2 is a distance between the support connecting point and a connecting point between the second supporting member and the bottom base, in which a ratio of A1 to A2 ranges from 0.6 to 0.75.

Further, the linkage member is further provided with a side plate connecting point and a back connecting point, in which the side plate connecting point is used for connecting to the support side plate and the back connecting point is used for connecting to the backrest mechanism, in which a distance H3 between the back connecting point and a bottom surface of the bottom base is greater than or equal to 3 cm during extension and retraction of the linkage mechanism.

Further, the swinging member is provided with a first connecting point, a second connecting point, and a third connecting point; the swinging member is rotatably connected to the first supporting member at the first connecting point, and rotatably connected to the support side plate at the third connecting point; B1 is a distance between the second connecting point and the third connecting point, while B2 is a distance between the second connecting point and the first connecting point, in which a ratio of B1 to B2 ranges from 0.6 to 0.7.

Further, an included angle θ between a connecting line between the second connecting point and the third connecting point and a connecting line between the second connecting point and the first connecting point is an acute angle.

Further, the seat unit also includes a driving mechanism and a leg mechanism, in which the leg mechanism is rotatably connected to a front of both the support side plate and the linkage mechanism, and the driving mechanism drives the leg mechanism to extend or retract, so as to drive the linkage mechanism, the support side plate and the backrest mechanism to move and adjust, so that the seat supporting frame is capable of moving among seated, extended, and reclined positions.

Provided in the present application is also a seat unit, including a bottom base, a linkage mechanism, a support side plate, a backrest mechanism and a seat backrest; the linkage mechanism is rotatably connected between the bottom base and the support side plate; the backrest mechanism is rotatably connected to the support side plate and the linkage mechanism respectively;

an exterior side of the support side plate is provided with a seat frame mounting surface; a height of a plane where the seat frame mounting surface is positioned is lower than an upper edge of the support side plate; a distance H between a highest point of the seat frame mounting surface and a bottom surface of the bottom base is 16 cm-19 cm;

the backrest mechanism includes a backrest mounting member and a backrest linkage member; the backrest mounting member is rotatably connected to the support side plate; two ends of the backrest linkage member are rotatably connected to the backrest mounting member and the linkage mechanism respectively; the backrest mounting member is connected to the seat backrest; the seat backrest comprises a backrest rear edge; when the seat supporting frame is retracted to an ultimate position, a plane where the backrest rear edge is positioned vertical to a horizontal plane is an initial plane; and when the backrest mechanism moves with the linkage mechanism and the support side plate between a retracted ultimate position and an extended ultimate position, the backrest rear edge does not move backward beyond the initial plane.

Further, the seat backrest further includes a backrest rear part and a body part; the backrest rear edge is positioned on a rear edge of the backrest rear part; a transverse width of the backrest rear part is greater than that of the body part; and when the backrest mechanism drives the seat backrest to rotate, the backrest rear part is able to revolve around seat armrests.

Further, when the seat backrest is retracted to an ultimate position, a distance H1 between the backrest rear edge and a bottom surface of the bottom base is 70 cm-85 cm.

Further, when the seat backrest is extended to an ultimate position, a distance H2 between the backrest rear edge and a bottom surface of the bottom base is 50 cm-65 cm.

Provided in the present application is also a seat, including seat armrests and a seat unit mentioned above, in which the seat unit is fixed to interior sides of the seat armrests by support side plate.

Compared to the prior art, the present application provides beneficial effects as follows.

By restricting an angular relationship between the backrest connecting part and the backrest mounting member, the present application, under circumstances of maintaining the extension length of the seat, allows the linkage mechanism and the support side plate to drive the backrest mechanism to translate forward and upward during extension of the seat supporting frame, so as to offset a distance caused by the backrest mechanism rotating backward, thereby ensuring that the seat backrest is provided with no clearance against a wall, which is more space-saving.

The optimization of the components of the linkage mechanism of the present application in terms of connecting angle and dimensional ratio allows the forward extension distance of the seat supporting frame to be further increased, and the reduction of the height of the linkage mechanism in combination with the seat frame mounting surface allows a seat height to be further reduced, thereby improving the stability of the structure.

The seat backrest of the present application may be a T-shaped frame structure with a wide backrest rear part. In contrast to conventional armrest grounding type products, the backrest rear part of the T-shaped seat backrest is able to revolve around the seat armrests on both sides during extension of the seat unit. The seat armrests move with the side plate linkage member, increasing the area of the seat backrest. The seat backrest may also be used for the armrest grounding type, and the design of the seat backrest and seat armrest is more flexible, which may meet the design of different seat styles, providing a more aesthetic appearance.

BRIEF DESCRIPTION OF THE DRAWINGS

In order to illustrate the technical solutions of the embodiments of the present application or of the prior art more clearly, the following drawings are briefly described as required in the context of the embodiments or the prior art. Obviously, the following drawings illustrate only some of the embodiments of the present application. Other relevant drawings may be obtained on the basis of the provided drawings without any creative effort by those skilled in the art.

Figure 1:
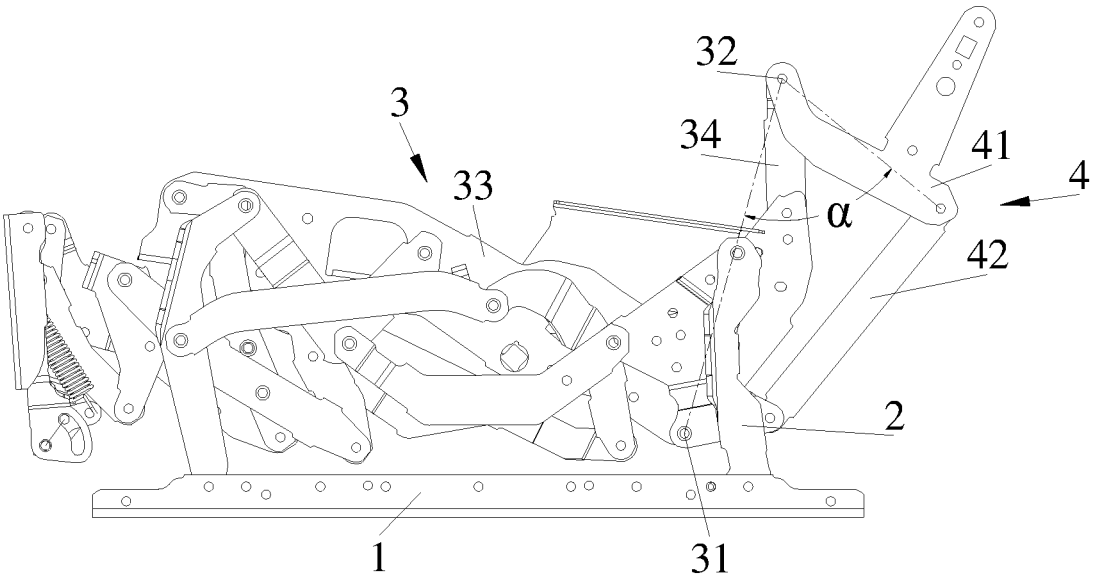
FIG. 1 is a structural diagram of the seat supporting frame of the present embodiment.

The attached drawings are labeled as: 1 bottom base; 2 linkage mechanism; 3 support side plate; 4 backrest mechanism; 31 side plate linkage point; 32 backrest point; 41 backrest mounting member; 42 backrest linkage member; 33 side plate body; 34 backrest connecting part; 411 frame mounting part; 5 seat backrest; 36 seat frame mounting surface; 51 backrest rear edge; 52 backrest rear part; 53 body part; 54 backrest body; 21 first supporting member; 22 swinging member; 23 middle connecting member; 24 linkage member; 25 second supporting member; 241 linkage point; 242 support connecting point; 243 side plate connecting point; 244 back connecting point; 221 first connecting point; 222 second connecting point; 223 third connecting point; 6 leg mechanism; 7 transmission mechanism; 11 first base; 12 second base; 61 transmission link; 71 linkage support; 72 transmission shaft; 8 driving mechanism; 81 driving motor; 82 sliding track; 83 sliding block; 9 seat armrest.

DETAILED DESCRIPTION OF THE PREFERRED EMBODIMENTS

In order to clarify the objects, technical solutions and advantages of the present application, the present application is described in detail in the following in conjunction with specific embodiments and with reference to the attached drawings. It should be understood that these descriptions are only exemplary and are not intended to limit the scope of the present application.

In the description of the present application, it is to be understood that, the terms such as "first", or "second" are used for descriptive objectives only and are not to be understood as indicating or implying relative importance or implying indication of the number of technical features indicated. Therefore, a feature defined as "first" or "second" may expressly or implicitly include one or more such features.

Additionally, in the present application, unless otherwise explicitly specified and limited, the terms such as "mount" and "connect" should be understood in a broad sense. For example, it may be a fixed connection, a detachable connection, or an integral connection; it may be a mechanical connection or an electrical connection; it may be a direct connection or an indirect connection through an intermediate medium; and it may be a communication within two elements. For those skilled in the art, the specific meaning of the above terms in the context of the present invention may be understood according to the specific situation.

Embodiment

Provided in the present embodiment is a seat, which may specifically be such as common posture-adjustable sofas, lounge chairs or massage chairs. The seat includes a seat unit for adjusting positions of the seat mounted on an inner side of armrests of the seat, the seat unit enabling the seat to be moved among a seated position, an extended position and a reclined position. The leg mechanism and the backrest mechanism of the seat unit are fully retracted to an ultimate position in the seated position; the leg mechanism is extended forward in the extended position, while an angle between the backrest mechanism and the seat frame remains unchanged; and the leg mechanism is extended forward to an ultimate position in the reclined position, while the backrest mechanism is extended backward to an ultimate position. In the present embodiment, an extension direction of the seat leg mechanism is "forward", and a direction opposite to that is "backward".

Specifically, in the present embodiment, a distance caused by the backrest mechanism rotating backward during the extension may be offset by the backrest mechanism translating forward and upward driven by the linkage mechanism and the support side plate, which may save the space rear to the backrest mechanism in a greatest extent, so that the seat backrest may be provided with no clearance to the rear neighboring objects, and may be extended to the reclined position without obstacles, such as placed against a wall with no clearance, where "no clearance" refers to the effect of saving space.

As shown in FIGS. 1-5, a linkage device for implementing no backrest clearance provided in the embodiment of the present application includes a bottom base 1, a linkage mechanism 2, a support side plate 3 and a backrest mechanism 4; the linkage mechanism 2 is rotatably connected between the bottom base 1 and the support side plate 3; and the backrest mechanism 4 is rotatably connected to the support side plate 3 and the linkage mechanism 2 respectively.

Specifically, the support side plate 3 is provided with a side plate linkage point 31 and a backrest point 32; the support side plate 3 is rotatably connected to the linkage mechanism 2 at the side plate linkage point 31; the support side plate 3 is rotatably connected to the backrest mechanism 4 at the backrest point 32; the backrest mechanism 4 includes a backrest mounting member 41 and a backrest linkage member 42; two ends of the backrest mounting member 41 are rotatably connected between the backrest point 32 and the backrest linkage member 42 respectively; and when the backrest mechanism 4 is retracted to an ultimate position, an included angle $\alpha$ between a connecting line between two ends of the backrest mounting member 41 and a connecting line between the backrest point 32 and the side plate linkage point 31 is an acute angle.

Figure 2:
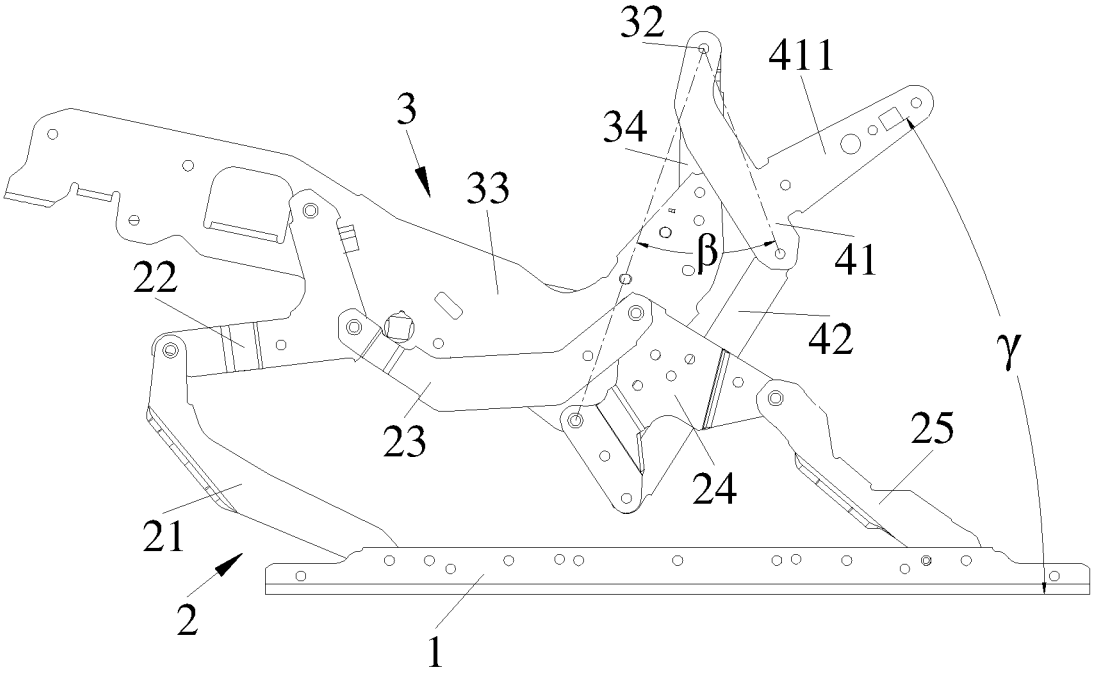
FIG. 2 is a structural diagram of the linkage mechanism and the backrest mechanism of the present embodiment.
Figure 4:
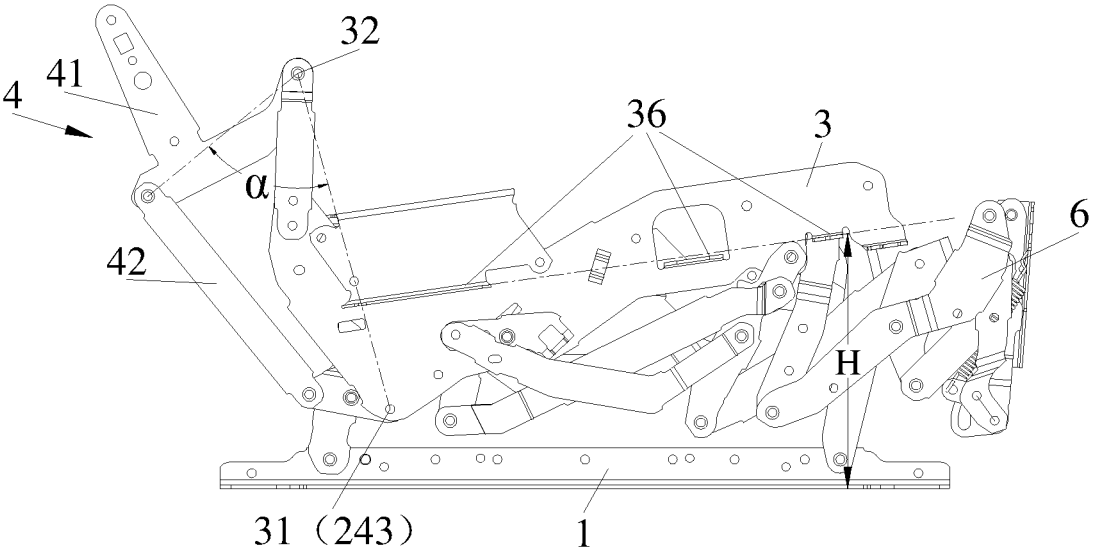
FIG. 4 is an opposite view of the FIG. 1.
Figure 5:
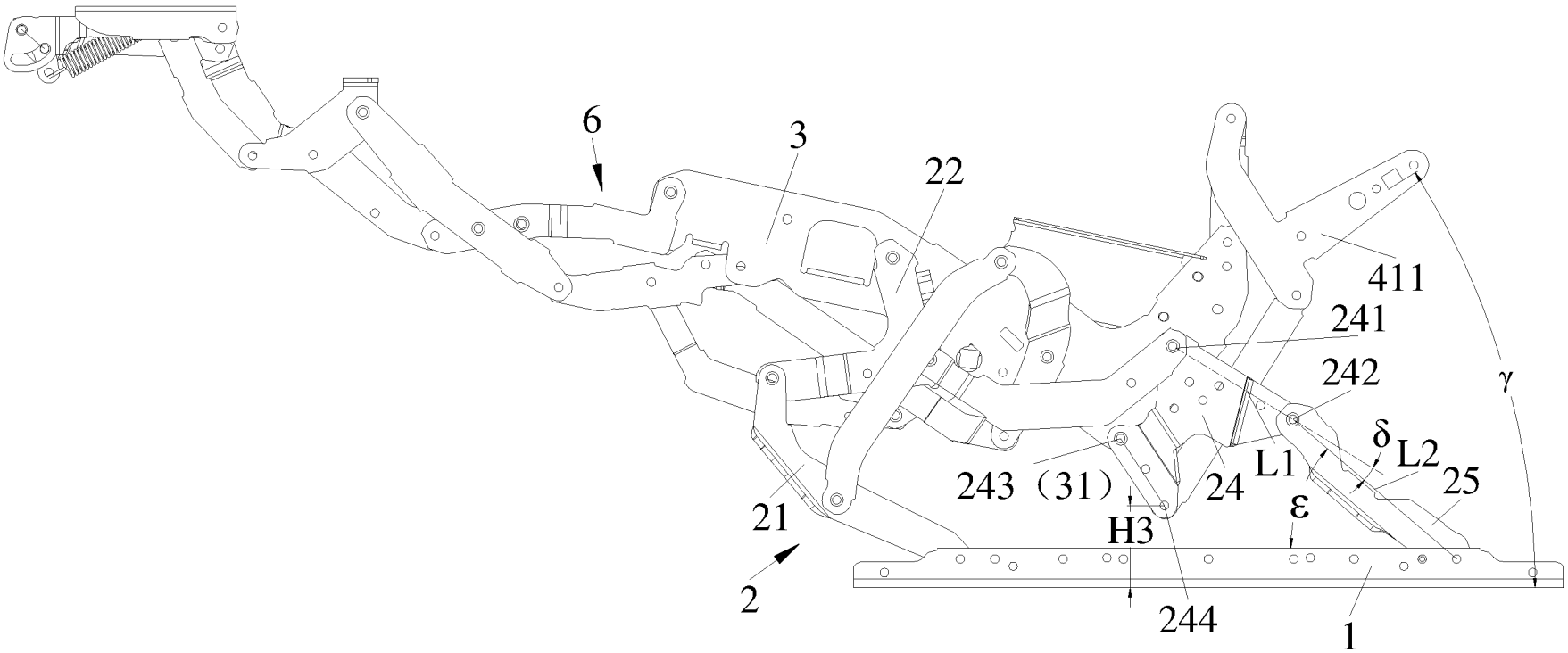
FIG. 5 is a structural diagram of the seat supporting frame of the present embodiment extended to an ultimate position.

Specifically, as shown in FIGS. 1, 2 and 4, when the backrest mechanism 4 is retracted to an ultimate position, an included angle $\alpha$ between a connecting line between two ends of the backrest mounting member 41 and a connecting line between the backrest point 32 and the side plate linkage point 31 is less than 70°, and may preferably be 48°, 50°, 55°, 60°, 65°, or 68°. In the present implementation, when the backrest mechanism 4 is retracted to an ultimate position, an included angle $\alpha$ between a connecting line between two ends of the backrest mounting member 41 and a connecting line between the backrest point 32 and the side plate linkage point 31 is 65°. When the backrest mechanism 4 is extended to an ultimate position, an included angle $\beta$ between a connecting line between two ends of the backrest mounting member 41 and a connecting line between the backrest point 32 and the side plate linkage point 31 is less than 45°, and may preferably be 30°, 35°, 40°, or 43°. Specifically, in the present implementation, when the backrest mechanism 4 is extended to an ultimate position, an included angle β between a connecting line between two ends of the backrest mounting member 41 and a connecting line between the backrest point 32 and the side plate linkage point 31 is 40°. When the backrest mounting member 41 is rotated backwardly and downwardly around the backrest point 32, the included angle α is decreased and the backrest mounting member 41 simultaneously moves forwardly with the support side plate 3. Compared to a conventional structure, in the present implementation, when the backrest mechanism 4 is in a seated position, an included angle α is set relatively small, in which the angle α is between a connecting line between two ends of the backrest mounting member 41 and a connecting line between the backrest point 32 and the side plate linkage point 31, so that an inclination angle of the seat backrest 5 is reduced after assembly, and the seat backrest 5 occupies less space. In the present implementation, the angle of the seat backrest 5 is optimized and restricted so that the seat backrest 5 is more compact in a seated state, and occupies less rear space. The distance that the backrest mechanism 4 drives the seat backrest 5 moving forward during extension is greater than or equal to the distance resulting from a backward rotation of the seat backrest 5, i.e., the backrest rear edge 51 does not exceed the initial plane during rotation of the seat backrest 5.

Specifically, in the present implementation, the support side plate 3 includes a backrest connecting part 34 and an L-shaped side plate body 33, in which the side plate body 33 and the backrest connecting part 34 are formed integrally or fixedly connected. The backrest connecting part is provided at an end of the support side plate connected to the backrest mechanism, in which the backrest point is provided on the backrest connecting part.

Specifically, the backrest mounting member 41 is a reverse-T-shaped connecting member. The backrest mounting member 41 is provided with a protruding frame mounting part 411, in which the frame mounting part 411 is used for mounting a seat backrest 5 of a seat; when the seat supporting frame is extended to an ultimate position, an included angle γ between the frame mounting part 411 and a horizontal plane is less than or equal to 35°. Preferably, in the present implementation, when extended to an ultimate position, the included angle γ between the frame mounting part 411 and a horizontal plane may be 30°, 32°, or 35°. The backrest mounting member 41 is rotated backwardly to extend and the angle between the backrest mounting member 41 and the horizontal plane is decreased, i.e., a backward rotation angle is increased, in which a total extension length of the backrest mechanism 4 is further increased. In the present implementation, a maximum rotation angle of the frame mounting part 411 ranges from 28° to 35°. Preferably, the maximum rotation angle of the frame mounting part 411 may be 28°, 30°, 32°, or 35°. In the present implementation, by increasing the maximum rotation angle of the backrest mounting part, the backrest extension distance may be increased and the position of head in the reclined position may be lowered, so that a weightless reclined position with legs higher than head may be achieved after extension, thereby increasing the comfort of the backrest.

In the present implementation, an exterior side of the support side plate 3 is provided with a seat frame mounting surface 36; the seat frame mounting surface 36 is used for mounting a seat frame; a height of a plane where the seat frame mounting surface 36 is positioned is lower than an upper edge of the support side plate 3; and a distance H between a highest point of the seat frame mounting surface 36 and a bottom surface of the bottom base 1 is 16 cm-19 cm. Preferably, the distance H may be 16 cm, 17 cm, 18 cm, or 19 cm. In the present implementation, as shown in FIG. 4, an exterior side of the support side plate 3 is provided with a plurality of seat frame mounting surfaces 36, in which the seat frame mounting surface 36 and the support side plate 3 are bent and formed integrally. The overall height of the support side plate 3 and the linkage mechanism 2 is decreased; the length of the components in the linkage mechanism 2 is shortened, and the strength thereof is increased; the mounting height of the seat frame is reduced; and the stability of the linkage mechanism 2 is increased, so that the height of the seat frame mounting surface of the present embodiment may meet the design requirements of a functional sofa or seat with a low seat height.

Specifically, in the present implementation, the linkage mechanism 2 includes a first supporting member 21, a swinging member 22, a middle connecting member 23, a linkage member 24, and a second supporting member 25; the first supporting member 21 and the second supporting member 25 are rotatably connected to two ends of the bottom base 1 respectively; the swinging member 22 is connected to the first supporting member 21; and two ends of the middle connecting member 23 are connected to the swinging member 22 and the linkage member 24 respectively.

Specifically, the linkage member 24 is provided with four connecting points rotatably connected to the middle connecting member 23, the support side plate 3, the second supporting member 25, and the backrest linkage member 42 respectively. The linkage member 24 is provided with a linkage point 241 and a support connecting point 242; the linkage member 24 is connected to the middle connecting member 23 at the linkage point 241; the linkage member 24 is connected to the second supporting member 25 at the support connecting point 242; L1 is a connecting line between the linkage point 241 and the support connecting point 242, while L2 is a connecting line between the support connecting point 242 and a connecting point between the second supporting member 25 and the bottom base 1; and when the linkage mechanism 2 is extended to an ultimate position, an included angle δ between L1 and L2 ranges from 8° to 15°.

It is to be noted that a co-linear position of the connecting line L1 and the connecting line L2 is a dead center position for a rotation of the second supporting member 25, in which the line L1 connecting the linkage point 241 and the support connecting point 242 and the line L2 connecting the support connecting point 242 and the connecting point between the second supporting member 25 and the bottom base 1, so that an included angle between the L1 and the L2 should be greater than 0° in order to ensure that the second supporting member 25 is capable of revolving successfully. Preferably, in the present implementation, the included angle δ between the second supporting member 25 and a connecting line of the linkage point 241 and the support connecting point 242 may be 8°, 9°, 10°, 12°, or 15°. In such a case, the second supporting member is capable of revolving successfully and may allow an extension distance of the second supporting member driven by the linkage member to be increased. Preferably, a restricting member may be provided between the second supporting member 25 and the bottom base 1, the restricting member being used for restricting a maximum forward rotation angle of the second supporting member, so that the second supporting member is capable of revolving successfully.

Specifically, when the linkage mechanism is extended forward to an ultimate position, an included angle ε between the second supporting member and a horizontal plane is less than 42°. Preferably, the included angle ε may be 38°, 40°, or 42°. In the present implementation, a forward rotation angle of the second supporting member 25 is increased, and an included angle between the second supporting member 25 and the bottom base 1 is decreased after rotated, in which the overall extension distance of the seat supporting frame is further increased. Therefore, under circumstance of a same extension length, dimensions of components in the linkage mechanism in the present embodiment may be decreased, and the overall height may be further decreased.

Specifically, A1 is a distance between the linkage point 241 and the support connecting point 242, while A2 is a distance between the support connecting point 242 and a connecting point between the second supporting member 25 and the bottom base 1, in which a ratio of A1 to A2 ranges from 0.6 to 0.75, and may preferably be 0.6, 0.65, 0.67, 0.7, or 0.75. Based on the above optimization of a rotation angle of the second supporting member 25 and a ratio of the component length and extension length of the second supporting member 25, it results in a reduction of the overall height of the linkage mechanism, an increase of the support strength, and an increase of the structural stability in the ratio range of the present implementation.

Specifically, the linkage member 24 is further provided with a side plate connecting point 243 and a back connecting point 244. The side plate connecting point 243 is used for connecting to the support side plate 3, i.e., the side plate connecting point 243 and the side plate linkage point 31 being the same point. The back connecting point 244 is used for connecting to the backrest mechanism 4. A distance H3 between the back connecting point 244 and a bottom surface of the bottom base 1 is greater than or equal to 3 cm during the extension and retraction of the linkage mechanism 2, so that the linkage member 24 does not contact and interfere with the ground during movement.

Figure 3:
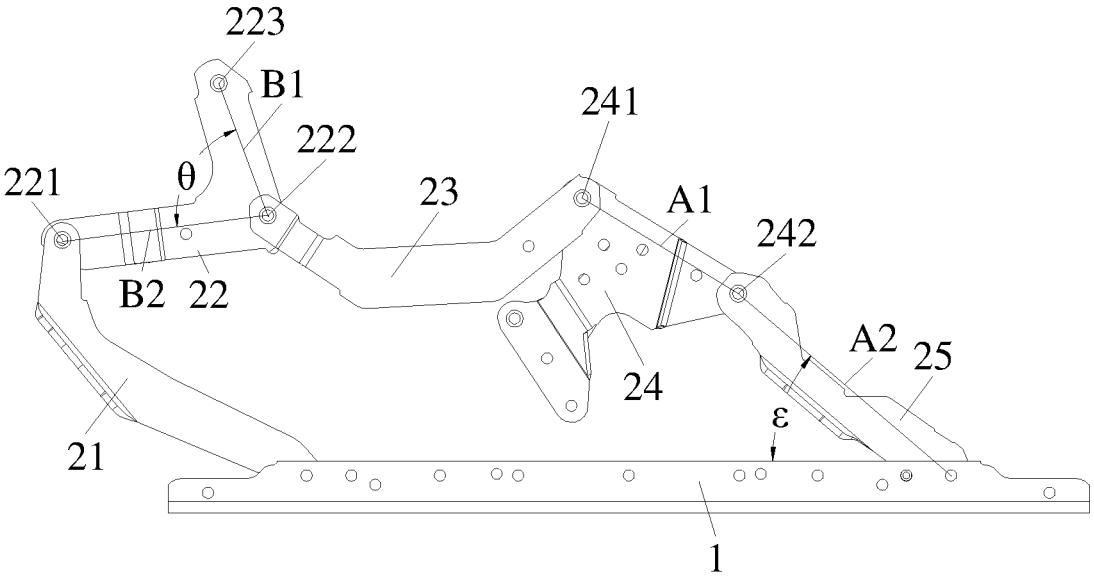
FIG. 3 is a structural diagram of the linkage mechanism of the present embodiment.

Specifically, as shown in FIG. 3, in the present implementation, the swinging member 22 is provided with a first connecting point 221, a second connecting point 222, and a third connecting point 223; the swinging member 22 is rotatably connected to the first supporting member 21 at the first connecting point 221, and rotatably connected to the middle connecting member 23 at the second connecting point 222, and rotatably connected to the support side plate 3 at the third connecting point 223; B1 is a distance between the second connecting point 222 and the third connecting point 223, while B2 is a distance between the second connecting point 222 and the first connecting point 221, in which a ratio of B1 to B2 ranges from 0.6 to 0.7. An included angle θ between a connecting line between the second connecting point 222 and the third connecting point 223 and a connecting line between the second connecting point 222 and the first connecting point 221 is an acute angle. Preferably, the included angle θ between a connecting line between the second connecting point 222 and the third connecting point 223 and a connecting line between the second connecting point 222 and the first connecting point 221 may be 70°, 72°, 76°, or 80°.

In the present implementation, all of the above optimizations may further allow the seat frame mounting height to be reduced and the forward movement distance of the seat supporting frame to be increased during extension thereof, providing more space for the seat backrest at the rear.

Figure 8:
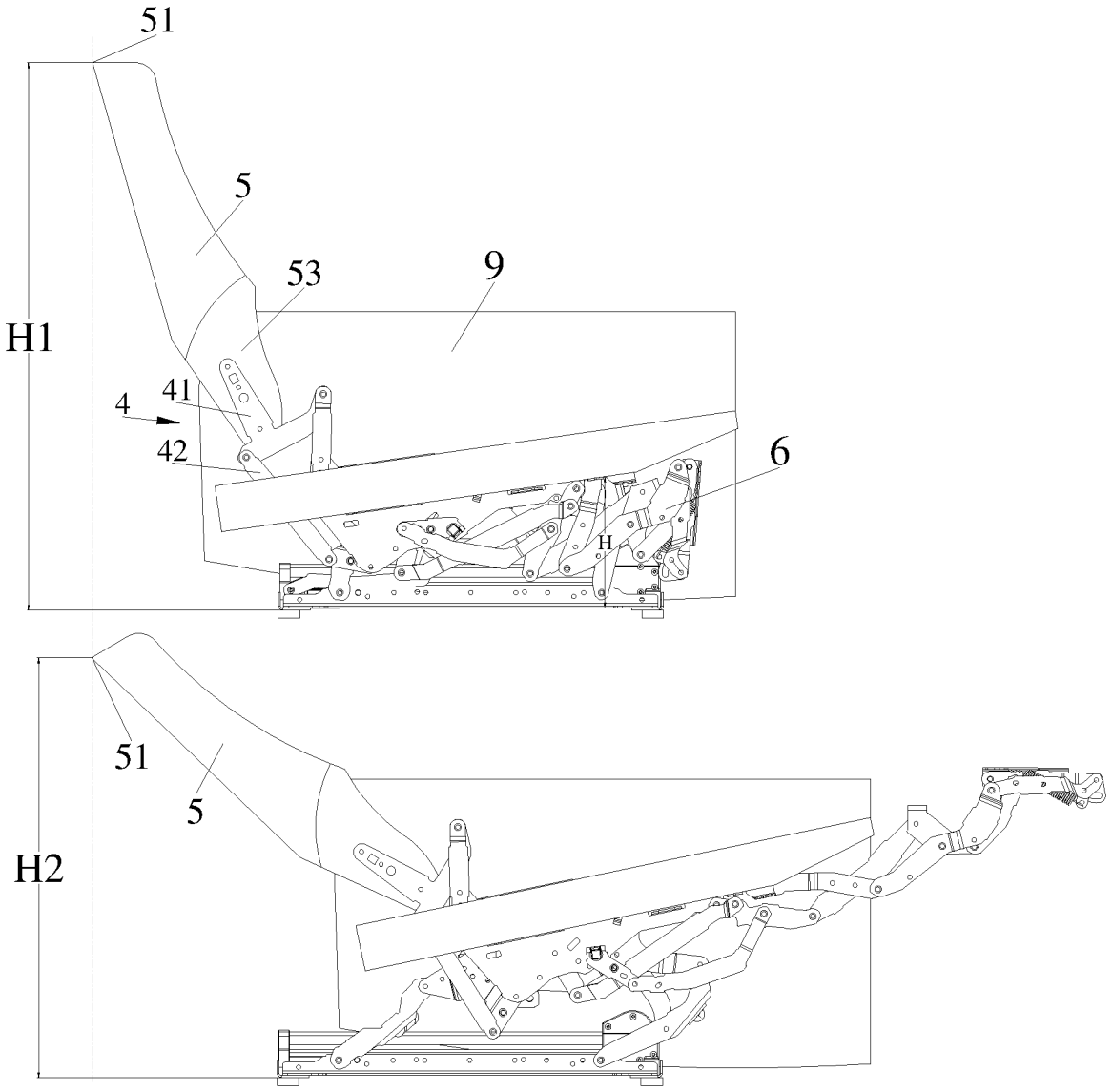
FIG. 8 is a structural diagram of the seat unit in a seated state and a reclined state in the present embodiment.
Figure 9:
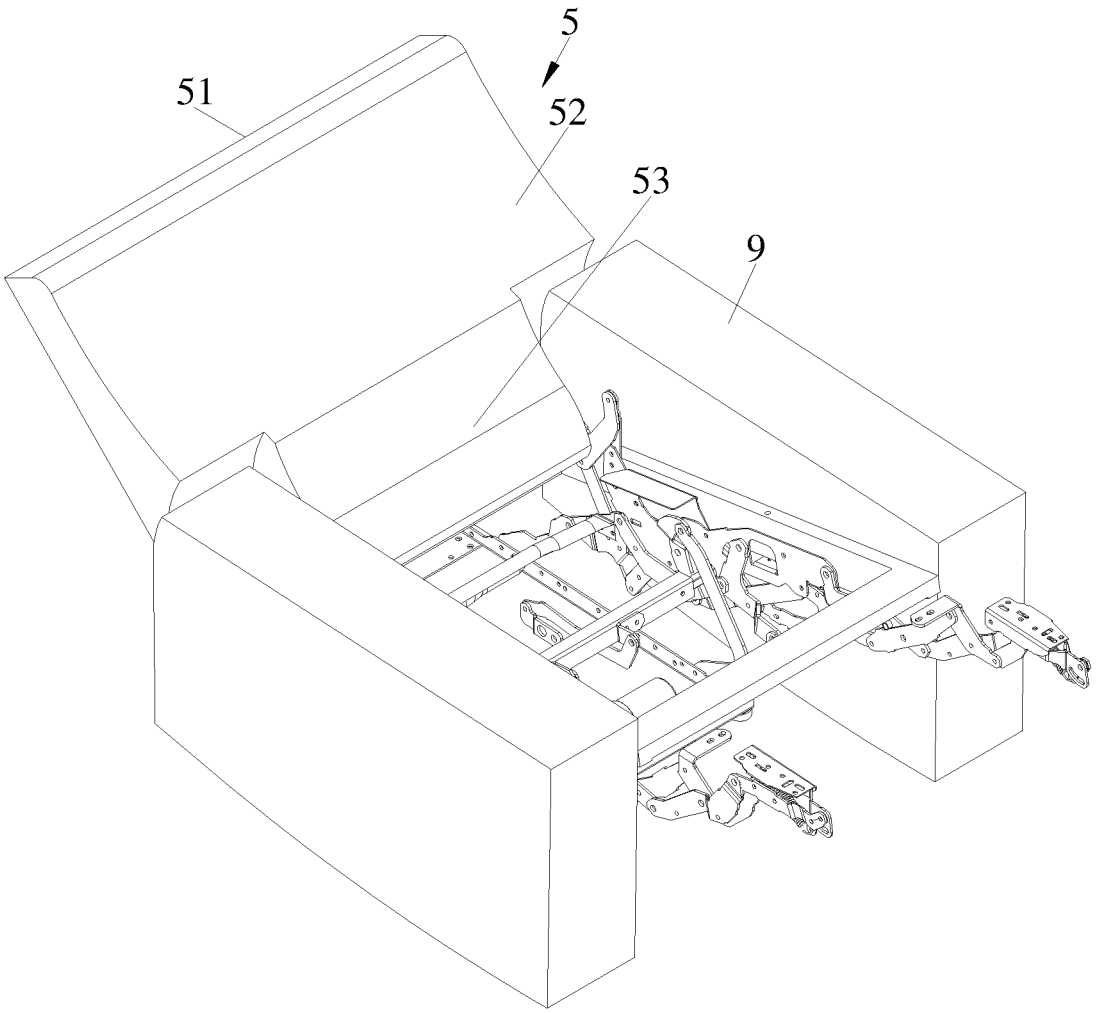
FIG. 9 is a structural diagram of the seat unit in the present embodiment with a T-shaped seat backrest.
Figure 10:
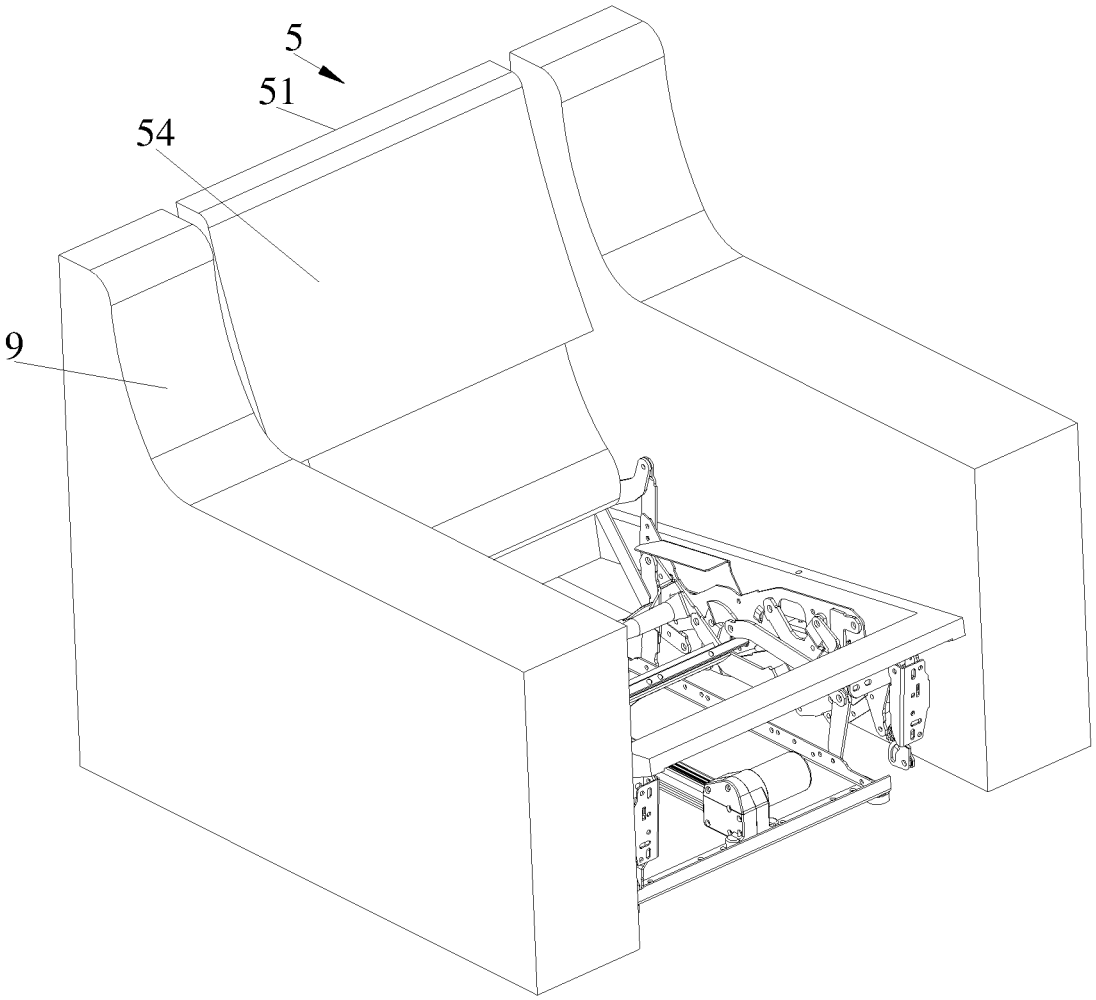
FIG. 10 is a structural diagram of the seat unit in the present embodiment with armrests reach to ground.

As shown in FIGS. 8-10, in the present implementation, the seat backrest further includes a seat backrest 5; the seat backrest 5 is connected to the backrest mounting member 41; the seat backrest 5 includes a backrest rear edge 51; when the seat supporting frame is retracted to an ultimate position, a plane where the backrest rear edge 51 is positioned vertical to a horizontal plane is an initial plane; and when the backrest mechanism 4 moves with the linkage mechanism 2 and the support side plate 3 between a retracted ultimate position and an extended ultimate position, the backrest rear edge 51 does not move backward beyond the initial plane.

Specifically, the seat backrest 5 further includes a backrest rear part 52 and a body part 53; the body part 53 is connected to the backrest mechanism 4; the backrest rear edge 51 is positioned on a rear edge of the backrest rear part 52; a transverse width of the backrest rear part 52 is greater than that of the body part 53; and when the backrest mechanism 4 drives the seat backrest 5 to rotate, the backrest rear part 52 is able to revolve around seat armrests.

Specifically, as shown in FIG. 8, in the present implementation, due to the structural optimization of the linkage mechanism 2 and the support side plate 3, the reduction of the overall height, and the change of the rotating angle of the backrest mechanism 4, the distance H1 between the backrest rear edge 51 and the bottom surface of the bottom base 1 is 70 cm-85 cm when the seat backrest 5 is retracted to an ultimate position. Preferably, the distance H1 between the backrest rear edge 51 and the bottom surface of the bottom base 1 may be 70 cm, 75 cm, 78 cm, 80 cm, or 85 cm. When the seat backrest 5 is extended to an ultimate position, a distance H2 between the backrest rear edge 51 and a bottom surface of the bottom base 1 is 50 cm-65 cm. Preferably, the distance H2 between the backrest rear edge 51 and a bottom surface of the bottom base 1 may be 50 cm, 58 cm, 60 cm, or 65 cm. Compared to the conventional seat unit with mechanical extension device, in the present implementation, the overall height of the seat backrest of the seat unit is decreased, and the aesthetics and flexibility of the backrest is increased.

Specifically, in the present implementation, the seat unit is fixed on an interior side of seat armrests 9 by the support side plate. In one implementation, as shown in FIG. 9, when the seat armrest 9 is fixed relative to the support side plate 3, the seat armrest 9 is a following armrest that moves with the support side plate 3. During the movement of the seat backrest 5 driven by the backrest mechanism 4, the backrest rear part 52 revolves around the seat armrest 9. When the backrest mechanism 4 is retracted to an ultimate position, a plane where the backrest rear edge 51 is positioned vertical to a horizontal plane is an initial plane. During the movement of the seat backrest 5 driven by the backrest mechanism 4, the backrest rear edge 51 does not move beyond the initial plane. In the present implementation, the seat may be designed as a seat style having a T-shaped seat backrest with a wide rear part and following seat armrests.

In another implementation, as shown in FIG. 10, when the seat armrest is fixed with respect to the bottom base 1, the seat backrest 5 includes a backrest body 54, in which a transverse width of the backrest body 54 is less than a distance between two seat armrests 9. It is to be noted that the seat armrest 9 is fixed with respect to a horizontal plane, i.e., the seat armrest reaching to the ground. Alternatively, it may also be referred to as an armrest-landing seat. When the backrest mechanism 4 is retracted to an ultimate position, a plane where the backrest rear edge 51 is positioned vertical to a horizontal plane is an initial plane. During the forward movement of the seat backrest 5 driven by the backrest mechanism 4, the backrest rear edge 51 does not move beyond the initial plane. That is, the rear edge of the seat moves forward away from the vertical plane or downward along the initial vertical plane during the backward rotation and extension of the seat backrest 5. When it is an armrest-landing seat, the seat armrest is fixed and motionless during adjusting positions, and the seat backrest 5 is translated and rotated between the two sides of armrests to adjust.

In the present implementation, the seat supporting frame also includes a leg mechanism 6; the leg mechanism 6 is rotatably connected to a front of the support side plate 3; and the leg mechanism 6 is unfolded and retracted in front of the support side plate. The leg mechanism is an extendable multi-linkage mechanism.

In the present implementation, the seat supporting frame is two sets of support structures that are identical and provided opposite to each other. The seat supporting frame also includes a first base 11 and a second base 12 provided at both ends of the bottom base 1 and connected to the two bottom bases 1 provided opposite to each other respectively, the two bottom bases 1 provided opposite to each other and the first base 11 and the second base 12 both connected thereto constituting a bottom frame structure.

Figure 6:
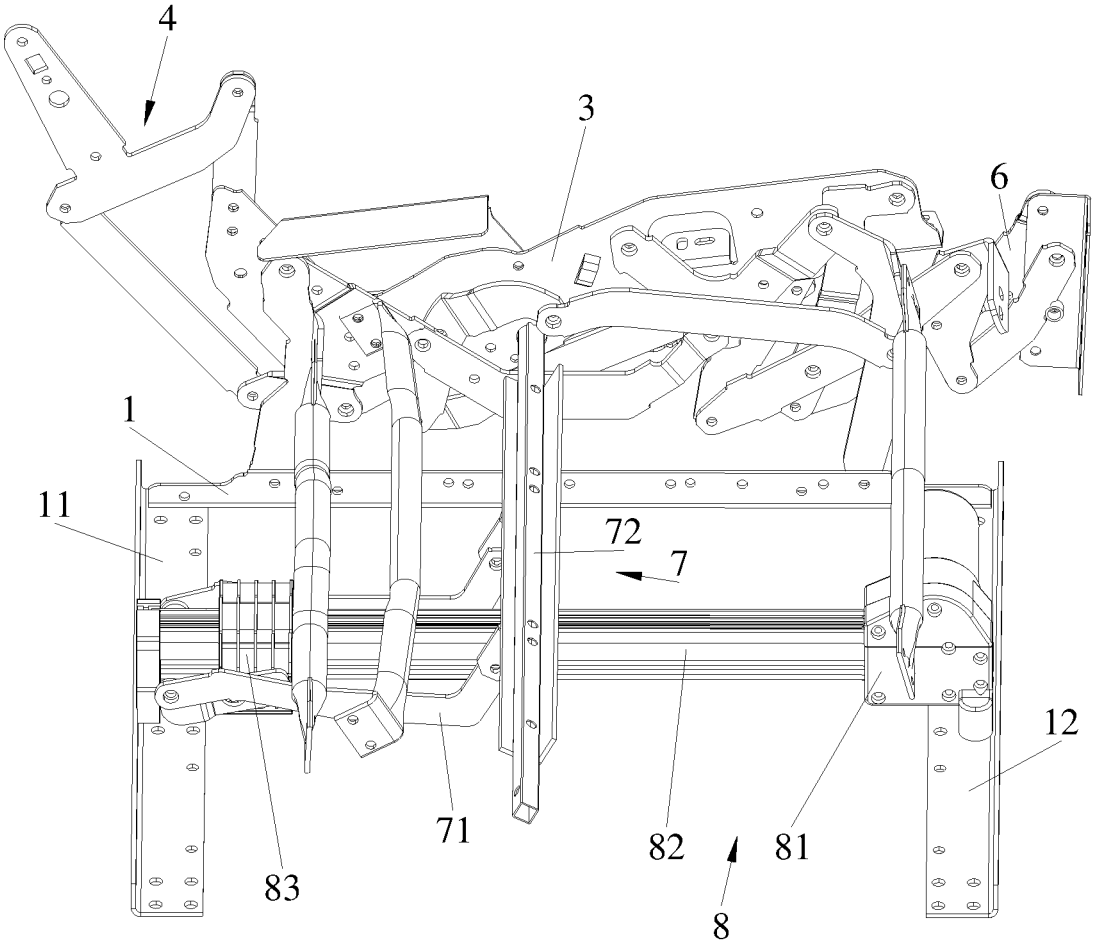
FIG. 6 is a connecting structural diagram of the transmission mechanism and the driving mechanism of the seat supporting frame in the present embodiment.
Figure 7:
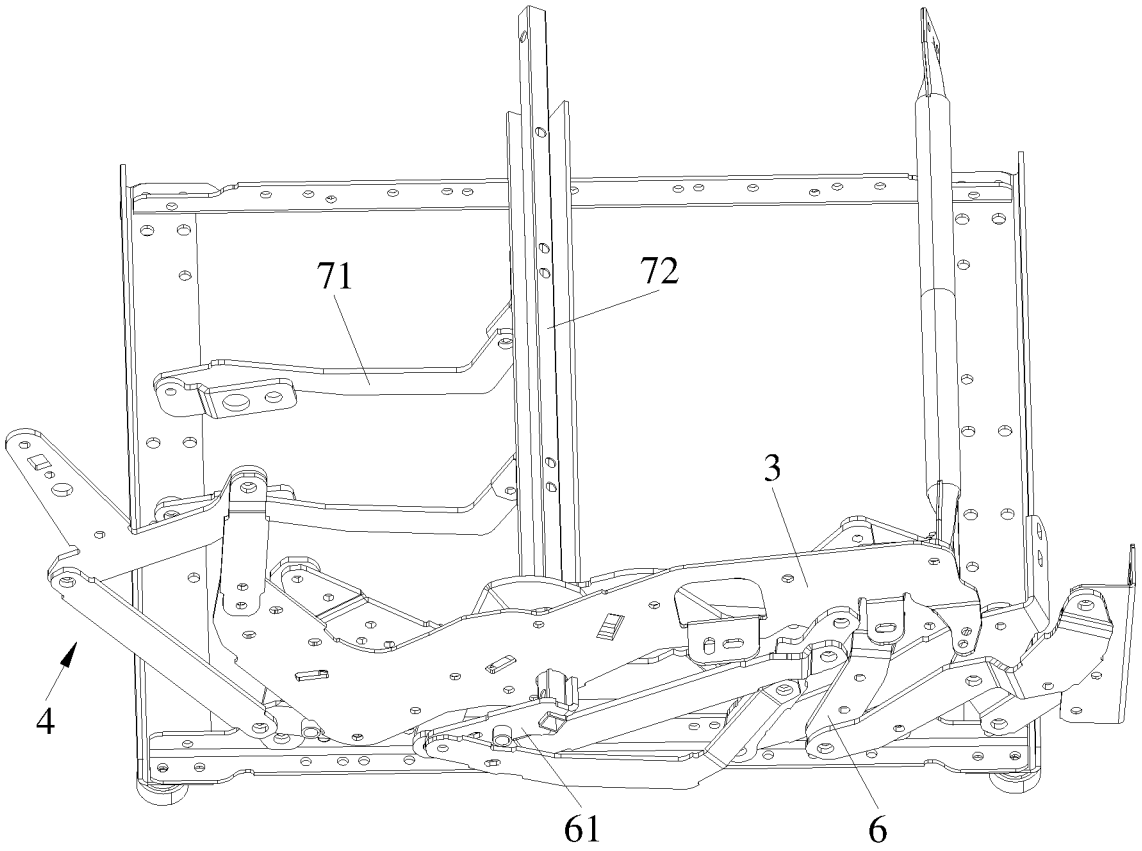
FIG. 7 is a connecting structural diagram of the transmission mechanism of the seat supporting frame in the present embodiment.

Specifically, as shown in FIGS. 6-7, the seat supporting frame also includes a transmission mechanism 7 and a driving mechanism 8, the transmission mechanism 7 including a linkage support 71 and a transmission shaft 72. Two ends of the transmission shaft 72 are in transmission connection with the leg mechanisms 6 on both sides respectively. An end of the linkage support 71 is connected to a middle of the transmission shaft 72, while an opposite end of the linkage support 71 is used to hinge to the sliding block 83 of the driving mechanism 8. Specifically, in some implementations, the support side plate 3 is provided with a through-hole. An end of the transmission shaft 72 passes through the through-hole and is connected to a transmission link 61 of the leg mechanism 6 provided on an exterior side of the support side plate 3, so that other link structures of the leg mechanism 6 is extended and retracted driven by the transmission link 61. In some other implementations, a bottom of the support side plate 3 is provided with a slot or a gap for passing through the transmission shaft 72. An end of the transmission shaft 72 passes through the slot or the gap and is connected to the transmission link 61 of the leg mechanism 6 provided on an exterior side of the support side plate 3. It is to be noted that, in the present implementation, a length of the transmission shaft 72 is greater than a distance between two support side plates 3, avoiding interference between components during movement due to a small interior space of the support side plate 3. Specifically, the transmission shaft 72 may be a transmission square tube.

Specifically, the driving mechanism 8 includes a driving motor 81, a sliding track 82 and a sliding block 83, in which the sliding track 82 is provided parallel to a horizontal plane, and the sliding block 83 is connected to the transmission shaft 72 by the linkage support 71. Specifically, an end of the sliding track 82 is fixed to the first base 11, while an opposite end of the sliding track 82 is connected to the driving motor 81, and the driving motor 81 is fixed to the second base 12. When the leg mechanism 6 and the backrest mechanism 4 are driven from a retracted position to a fully extended ultimate position, a sliding travel of the sliding block 83 is 26 cm-33 cm. Preferably, the sliding travel of the sliding block 83 may be 26 cm, 27 cm, 28 cm, 30 cm, or 33 cm. In the present implementation, when the sliding block 83 drives the transmission shaft 72 from a fully retracted ultimate position to a fully extended ultimate position, a distance of the transmission shaft 72 moving forward is greater than or equal to 20 cm, and may preferably be 20 cm, 22 cm, or 25 cm. For example, in some implementations, when a maximum sliding travel of the sliding block 83 is 28 cm, a distance of the transmission shaft 72 driven to move forward is greater than 20 cm.

In the present implementation, the driving mechanism 8 cooperates with the transmission mechanism 7 so that the sliding travel of the sliding block 83 driving the transmission shaft 72 is longer under the circumstance of a lower height of the transmission shaft 72, and an extension distance of the seat backrest mechanism and the leg mechanism is increased, which also provides a higher pushing precision and pushing efficiency. It should be noted that a conventional pushrod motor is required to be mounted on the base obliquely and provides a long pushrod travel. In the existing seat driving mechanism, an end of sliding track is a free end. When a sliding block slides on the sliding track, the sliding track swings with respect to the base, which results in a change in the gravity center of the drive. The driving process is prone to shaking and jamming, and the drive is not stable. Compared to a conventional driving mechanism, in the present implementation, the sliding track 82 of the driving mechanism 8 is provided parallel to a horizontal plane. Two ends of the sliding track 82 are both fixed. The driving motor 81 drives the sliding block 83 to slide in a straight line on the sliding track 82. The height of the transmission shaft 72 is relatively low. The gravity center of the transmission and the gravity center of the driving mechanism 8 are proximal to the bottom base 1, so that the driving process is more stable and smoother, improving the pushing precision.

In the present implementation, the driving mechanism 8 drives the transmission mechanism 7 to move, so as to drive the leg mechanism 6 to extend forward, which drives then the linkage mechanism 2, the support side plate 3 and the backrest mechanism 4 to move and adjust, so that the seat supporting frame is capable of moving among seated, extended, and reclined positions.

By restricting an angular relationship between the backrest connecting part and the backrest mounting member, the present application, under circumstances of maintaining the extension length of the seat, allows a distance of the backrest mechanism translating forward and upward to increase, which is driven by linkage mechanism and the support side plate during extension of the seat unit, so as to offset a distance caused by the backrest mechanism rotating backward, thereby ensuring that the seat backrest of the seat unit is provided with no clearance against the wall, which is more space-saving. In the present application, the extension distance of the seat unit is increased by the combined improvement of such as the linkage mechanism or the backrest mechanism, while a seat height is greatly reduced, so that the stability of the structure and the comfort of the seat is increased.

The seat backrest of the present application may be a T-shaped frame structure with a wide backrest rear part. In contrast to conventional armrest grounding type products, the backrest rear part of the T-shaped seat backrest is able to revolve around the seat armrests on both sides during the extension of the seat unit. The seat armrests move with the side plate linkage member, increasing the area of the seat backrest. The seat backrest may also be used for the armrest grounding type, and the design of the seat backrest and seat armrest is more flexible, which may meet the design of different seat styles, providing a more aesthetic appearance.

It should be understood that the above specific embodiments of the present application are used only for exemplary illustration or explanation of the principles of the present application and do not constitute a limitation of the present application. Therefore, any modifications, equivalent substitutions, improvements, and the like made without departing from the spirit and scope of the present application fall within the scope of protection of the present application.

The invention claimed is:

1. A linkage device for implementing no backrest clearance, characterized by comprising a bottom base, a linkage mechanism, a support side plate and a backrest mechanism; the linkage mechanism is rotatably connected between the bottom base and the support side plate; the backrest mechanism is rotatably connected to the support side plate and the linkage mechanism respectively;

the support side plate is provided with a side plate linkage point and a backrest point; the support side plate is rotatably connected to the linkage mechanism at the side plate linkage point; the support side plate is rotatably connected to the backrest mechanism at the backrest point;

the backrest mechanism comprises a backrest mounting member and a backrest linkage member; two ends of the backrest mounting member are rotatably connected between the backrest point and the backrest linkage member respectively; and when the backrest mechanism is retracted to an ultimate position, an included angle $\alpha$ between a connecting line between two ends of the backrest mounting member and a connecting line between the backrest point and the side plate linkage point is an acute angle.

2. The linkage device for implementing no backrest clearance according to claim 1, characterized in that the support side plate comprises a backrest connecting part and an L-shaped side plate body, wherein the side plate body and the backrest connecting part are formed integrally or fixedly connected.

3. The linkage device for implementing no backrest clearance according to claim 2, characterized in that the backrest connecting part is provided at an end of the support side plate connected to the backrest mechanism, wherein the backrest point is provided on the backrest connecting part.

4. The linkage device for implementing no backrest clearance according to claim 3, characterized in that when the backrest mechanism is retracted to an ultimate position, an included angle $\alpha$ between a connecting line between two ends of the backrest mounting member and a connecting line between the backrest point and the side plate linkage point is less than 70°.

5. The linkage device for implementing no backrest clearance according to claim 3, characterized in that when the backrest mechanism is extended to an ultimate position, an included angle $\beta$ between a connecting line between two ends of the backrest mounting member and a connecting line between the backrest point and the side plate linkage point is less than 45°.

6. The linkage device for implementing no backrest clearance according to claim 3, characterized in that the backrest mounting member is provided with a protruding frame mounting part, wherein the frame mounting part is used for mounting a seat backrest of a seat; when the linkage device is extended to an ultimate position, an included angle $\gamma$ between the frame mounting part and a horizontal plane is less than or equal to 35°.

7. A seat supporting frame, characterized by comprising a bottom base, a linkage mechanism, a support side plate and a backrest mechanism; the linkage mechanism is rotatably connected between the bottom base and the support side plate; the backrest mechanism is rotatably connected to the support side plate and the linkage mechanism respectively;

the linkage mechanism comprises a first supporting member, a swinging member, a middle connecting member, a linkage member, and a second supporting member; the first supporting member and the second supporting member are rotatably connected to two ends of the bottom base respectively; the swinging member is connected to the first supporting member; two ends of the middle connecting member are connected to the swinging member and the linkage member respectively;

the linkage member is provided with a linkage point and a support connecting point; the linkage member is connected to the middle connecting member at the linkage point; the linkage member is connected to the second supporting member at the support connecting point; L1 is a connecting line between the linkage point and the support connecting point, while L2 is a connecting line between the support connecting point and a connecting point between the second supporting member and the bottom base; and when the linkage mechanism is extended to an ultimate position, an included angle $\delta$ between L1 and L2 ranges from 8° to 15°.

8. The seat supporting frame according to claim 7, characterized in that when the linkage mechanism is extended forward to an ultimate position, an included angle $\varepsilon$ between the second supporting member and a horizontal plane is less than 42°.

9. The seat supporting frame according to claim 7, characterized in that A1 is a distance between the linkage point and the support connecting point, while A2 is a distance between the support connecting point and a connecting point between the second supporting member and the bottom base, wherein a ratio of A1 to A2 ranges from 0.6 to 0.75.

10. The seat supporting frame according to claim 7, characterized in that the linkage member is further provided with a side plate connecting point and a back connecting point, wherein the side plate connecting point is used for connecting to the support side plate and the back connecting point is used for connecting to the backrest mechanism, wherein a distance H3 between the back connecting point and a bottom surface of the bottom base is greater than or equal to 3 cm during extension and retraction of the linkage mechanism.

11. The seat supporting frame according to claim 7, characterized in that the swinging member is provided with a first connecting point, a second connecting point, and a third connecting point; the swinging member is rotatably connected to the first supporting member at the first connecting point, and rotatably connected to the support side plate at the third connecting point; B1 is a distance between the second connecting point and the third connecting point, while B2 is a distance between the second connecting point and the first connecting point, wherein a ratio of B1 to B2 ranges from 0.6 to 0.7.

12. The seat supporting frame according to claim 11, characterized in that an included angle $\theta$ between a connecting line between the second connecting point and the third connecting point and a connecting line between the second connecting point and the first connecting point is an acute angle.

13. The seat supporting frame according to claim 7, characterized by further comprising a driving mechanism and a leg mechanism, wherein the leg mechanism is rotatably connected to a front of both the support side plate and the linkage mechanism, and the driving mechanism drives the leg mechanism to extend or retract, so as to drive the linkage mechanism, the support side plate and the backrest mechanism to move and adjust, so that the seat supporting frame is capable of moving among seated, extended, and reclined positions.

14. A seat unit, characterized by comprising a bottom base, a linkage mechanism, a support side plate, a backrest mechanism and a seat backrest; the linkage mechanism is rotatably connected between the bottom base and the support side plate; the backrest mechanism is rotatably connected to the support side plate and the linkage mechanism respectively;

an exterior side of the support side plate is provided with a seat frame mounting surface; a height of a plane where the seat frame mounting surface is positioned is lower than an upper edge of the support side plate; a distance H between a highest point of the seat frame mounting surface and a bottom surface of the bottom base is 16 cm-19 cm;

the backrest mechanism comprises a backrest mounting member and a backrest linkage member; the backrest mounting member is rotatably connected to the support side plate; two ends of the backrest linkage member are rotatably connected to the backrest mounting member and the linkage mechanism respectively; the backrest mounting member is connected to the seat backrest; the seat backrest comprises a backrest rear edge; when the seat supporting frame is retracted to an ultimate position, a plane where the backrest rear edge is positioned vertical to a horizontal plane is an initial plane; and when the backrest mechanism moves with the linkage mechanism and the support side plate between a retracted ultimate position and an extended ultimate position, the backrest rear edge does not move backward beyond the initial plane.

15. The seat unit according to claim 14, characterized in that the seat backrest further comprises a backrest rear part and a body part; the backrest rear edge is positioned on a rear edge of the backrest rear part; a transverse width of the backrest rear part is greater than that of the body part; and when the backrest mechanism drives the seat backrest to rotate, the backrest rear part revolves around seat armrests.

16. The seat unit according to claim 14, characterized in that when the seat backrest is retracted to an ultimate position, a distance H1 between the backrest rear edge and a bottom surface of the bottom base is 70 cm-85 cm.

17. The seat unit according to claim 16, characterized in that when the seat backrest is extended to an ultimate position, a distance H2 between the backrest rear edge and a bottom surface of the bottom base is 50 cm-65 cm.

* * * * *